US006832392B2

(12) United States Patent
Palmer et al.

(10) Patent No.: US 6,832,392 B2
(45) Date of Patent: Dec. 21, 2004

(54) CHEMILUMINESCENTLY ILLUMINATED COSTUME SAFETY MASK

(75) Inventors: Stephen L. Palmer, Cameron Park, CA (US); William R. Palmer, Rescue, CA (US); Frank J. Commisso, East Longmeadow, MA (US)

(73) Assignee: Omniglow Corporation, West Springfield, MA (US)

( * ) Notice: Subject to any disclaimer, the term of this patent is extended or adjusted under 35 U.S.C. 154(b) by 19 days.

(21) Appl. No.: 10/404,905

(22) Filed: Apr. 1, 2003

(65) Prior Publication Data

US 2004/0194195 A1 Oct. 7, 2004

(51) Int. Cl.[7] ..... A42B 1/18
(52) U.S. Cl. ..... 2/206; 2/9; 2/424
(58) Field of Search ..... 2/6.3, 6.4, 6.5, 2/6.7, 424, 432, 9, 206, 173, 427, 15, 69; 446/27; 132/319; 422/52; 362/34, 84; 252/700

(56) References Cited

U.S. PATENT DOCUMENTS

| | | | | | |
|---|---|---|---|---|---|
| 3,539,794 | A | * | 11/1970 | McKay | 240/2.25 |
| 3,576,987 | A | * | 5/1971 | Voight et al. | 362/34 |
| 3,691,085 | A | * | 9/1972 | Roberts et al. | 252/700 |
| 3,704,231 | A | * | 11/1972 | Bollyky | 252/700 |
| 4,193,109 | A | | 3/1980 | Heffernan et al. | |
| 4,682,544 | A | * | 7/1987 | Koroscil et al. | 102/336 |
| 4,751,616 | A | * | 6/1988 | Smithey | 362/34 |
| 4,814,949 | A | * | 3/1989 | Elliott | 362/34 |
| 4,864,663 | A | * | 9/1989 | Horan | 2/206 |
| 4,941,212 | A | * | 7/1990 | Liff | 2/206 |
| 5,121,302 | A | * | 6/1992 | Bay et al. | 362/34 |
| 5,465,427 | A | * | 11/1995 | Shields | 2/206 |
| 5,546,604 | A | * | 8/1996 | Geller | 2/202 |
| 5,765,231 | A | * | 6/1998 | Leonard et al. | 2/206 |
| 5,787,508 | A | | 8/1998 | Gattamorta | |
| 5,970,522 | A | | 10/1999 | Apichom | |
| 6,035,447 | A | | 3/2000 | Hsia | |
| 6,061,830 | A | * | 5/2000 | Geller | 2/69 |
| 6,093,475 | A | | 7/2000 | Geller | |
| 6,419,541 | B1 | * | 7/2002 | Apichom | 446/73 |
| 6,622,816 | B2 | * | 9/2003 | Falco et al. | 181/135 |
| 6,663,255 | B1 | * | 12/2003 | Carito | 362/34 |
| 2003/0167556 | A1 | * | 9/2003 | Kelley | 2/206 |

* cited by examiner

*Primary Examiner*—John J. Calvert
*Assistant Examiner*—Alissa L. Hoey
(74) *Attorney, Agent, or Firm*—McHale & Slavin, P.A.

(57) ABSTRACT

A costume safety mask housing chemiluminescent reagents. Upon activation, the reagents illuminate the mask or features thereon for purposes of novelty illumination and safety of the wearer. The mask may include liquid, viscous liquid, or solid chemiluminescent reagents that are held in cavities. Liquid components of the instant invention may be transported through passageways in the mask to provide a flowing appearance.

24 Claims, 5 Drawing Sheets

CHEMILUMINESCENTLY ILLUMINATED COSTUME SAFETY MASK

FIELD OF THE INVENTION

This invention relates to the field of chemiluminescent novelty items and, in particular, to costume masks that provide safety illumination to the wearer by use of chemiluminescent illumination.

BACKGROUND OF THE INVENTION

Costume masks are commonly found at parties, celebrations and the like events. Masks are designed to have a decorative appearance, often enhanced by the use of color, texture and shape. Masks may further utilize foils, sequins, fluorescent paints, or like mechanisms capable of enhancing the visual appearance of the mask.

"All Saints Day" commonly referred to as Halloween, is one such celebration practiced in numerous countries wherein people dress up in costume outfits. This event is enjoyed particularly by young children who visit the neighboring homes after dark where candy gifts are presented. It is well known that masks restrict visibility of the wearer and when the mask is worn when lighting is poor, the combination is most dangerous since safety is then dependant upon someone else, such as an automobile driver.

For instance, the mask disclosed in U.S. Pat. No. 5,970,522 fits over the face of a person and employs an inflatable sack that causes a feature of the mask, such as the eyeball, to protrude. Slots within the forehead of the mask allow the wearer to see, however, the limitation placed upon the viewable area is severe making the wearer dependant upon others for their safety.

U.S. Pat. No. 5,787,508 discloses yet another decorative mask that is inflated to create a three dimensional format. Again, apertures placed in the mask will also cause a restriction in visibility.

Thus, a need presents itself to make the mask wearer visible to others so as to provide the wearer with a heightened level of safety to compensate for the loss of visibility.

U.S. Pat. No. 6,035,447 discloses a mask that includes a flashing LED for enhanced safety. The inventor recognized the need for integrating a safety item into the theme of the mask for safety purposes. However, the inventor did not recognize how the entire mask could be enhanced for safety purposes without loss of the costume theme.

While the Applicant is known for producing many self-illumination safety products, it is also known that if a safety item distracts from the costume, it will not be worn. Thus, even if a parent demands that a child wear illumination items while venturing out in the evening, it is not uncommon for the child to remove or conceal the safety materials as soon as they are out of the parent's sight.

U.S. Pat. No. 4,193,109 discloses a personal marker device that is a well established safety item used by boaters, hikers, bike riders, joggers and so forth. However, such a device will distract from a costume theme making the use of the device obvious for safety only. By use of a passive or active chemiluminescently illuminated costume safety mask, the visibility and safety of the wearer is greatly enhanced and while safety is maintained, it does not appear to be the obvious reason. A passive chemiluminescent light may be derived from an immobilized chemiluminescent material such as thixotropic reactant composition, or from conventional chemiluminescent reactant compositions that employ a liquid oxalate and liquid activator.

U.S. Pat. No. 6,093,475 employs a flowing liquid to enhance the mask. However, the liquid is simply colored and is used to simulate blood, thereby requiring the presence of reflected light to be transmitted to the observer by reflection from a transparent area of the mask. This limits the effectiveness of such a mask to areas having sufficient lighting for viewing, and limits materials of construction to transparent plastic in order for the blood effect to be visible, and is only for use as a horror mask.

Thus, what is lacking in the art is a chemiluminescent costume mask that becomes the focal point of a costume. The enhanced visual appearance increasing the likelihood that the mask be an essential aspect of the costume and will be worn at all times, thereby increasing the safety of the wearer.

SUMMARY OF THE INVENTION

The instant invention consists of a mask that can be shaped to simulate a human, robot, alien, animal or other feature such as a face, heart, kidney, spine, limb, veins, appendages, and so forth. In a preferred embodiment, the mask consists of two pieces of plastic that are sealed together to create at least one cavity or passageway therebetween. The cavity houses chemiluminescent reagents that, when activated, provide self-illumination for safety as well as novelty use.

By way of example, a face mask employing a white chemiluminescent reagent may provide the wearer with the appearance of a ghost. Such a mask could be viewed without any ambient light providing both novelty and safety should it be worn by a child while trick or treating. Other examples would be a face mask having cheeks that glow pink to enhance a young child's appearance, a glowing green forehead to depict an alien, a red nose to depict Rudolph the fictitious reindeer, and so forth.

The cavities or passageways are used to house various chemiluminescent reagents for use in enhancing a particular feature of the mask. Such passageways may be separated to house different reagents. For instance, a face mask may have all of the above features and more such as red lips, yellow ears, blue teeth and so forth. The passageways can further include various sized apertures to allow liquid to flow from one cavity to another.

The flow of fluid can be through the use of gravity or by use a pump to cause circulation. A pump may be located external the mask, or formed integral thereto. Each such embodiment requires the activator and oxalate of the chemiluminescent reagents to be maintained in separate areas until use. The chemiluminescent reagents may be liquid, viscous liquid, or solid such as a thixotropic component.

Accordingly, an objective of the instant invention is to disclose the distribution of light in a costume mask to provide augmented illumination from chemiluminescent reagents providing high visibility to the wearer.

Another objective of the instant invention is to provide a safety mask that creates a costume focal point that will be worn throughout a celebration thereby maintaining the safety aspects of illumination at night.

Yet another objective of the invention is to provide a costume mask that employs gravity to cause flowing movement of chemiluminescent reagents.

Still another objective of the invention is to provide a costume mask that employs a fluid pump to circulate chemiluminescent reagents.

Yet another objective of the instant invention is to provide a costume safety mask wherein at least a portion of the chemiluminescent reagents is solid, such as that provided through a thixotropic component.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
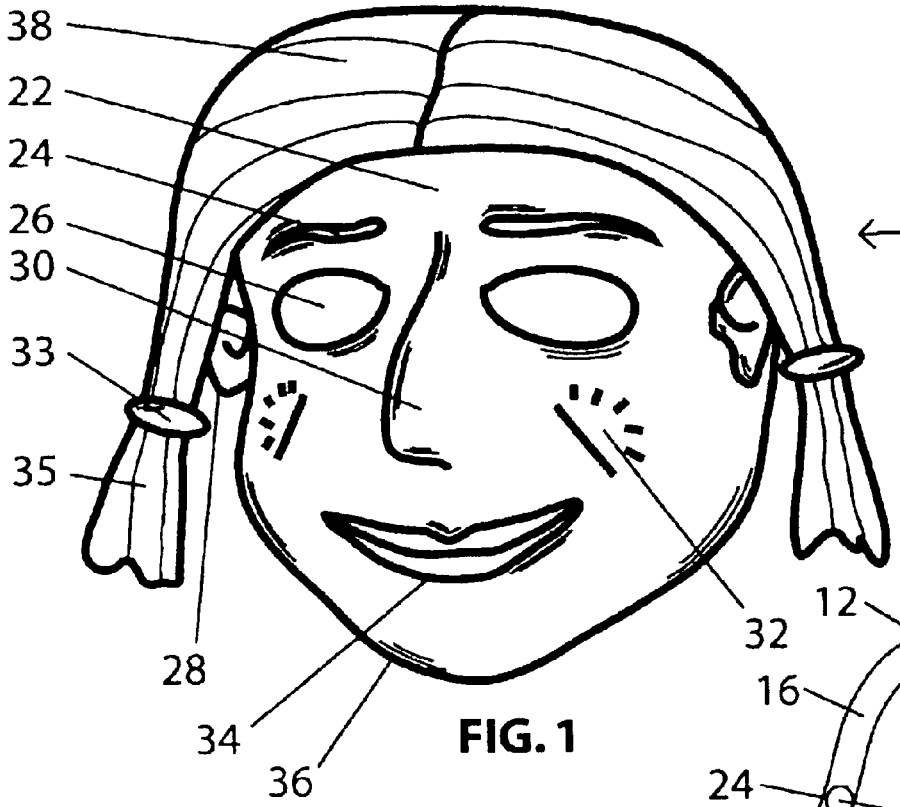
FIG. 1 is a front perspective view of a chemiluminescent face mask of the instant invention depicting a young girl with pigtails.

Now referring to the Figures, set forth are illustrative costume safety masks illuminated through the use of a chemiluminescent light. The face masks are constructed from a lightweight moldable plastic material having a first side surface 12 that is sealed 13 to a second side surface 14 forming a cavity 16 therebetween. The seal 13 may be defined as a continuous weldment between the first and second side surfaces, partial weldments around isolated areas, or consist of a conventional sealant material such as silicone. Openings 18 and 20, located at either end of the cavity 16, can be used to permit liquids to enter and exit the mask should a recirculation of a fluid be desired.

The chemiluminescent chemical employed is well known. Devices able to emit light by the mixing of two liquid chemicals are well known, see U.S. Pat. Nos. 3,539,794, 3,576,987, 4,193,109, 4,682,544, 4,751,616, 4,814,949 and 5,121,302. Such lighting devices generally involve the use of two chambers, one chamber containing a first liquid chemical referred to as an oxalate solution, and the second chamber containing a second liquid chemical referred to as an activator solution. These two chambers must have a barrier to maintain separation of the oxalate and activator until use since the oxalate solution is sensitive to any contamination. Therefore, in practice, the oxalate solution is typically enclosed in a breakable glass ampule. Typically the chemical light is produced by mixing an oxalate ester and hydrogen peroxide together in the presence of a catalyst and a fluorescer.

The face mask illustrated in FIG. 1 is that of a young girl having normal facial features including a forehead 22, eyebrows 24, eyes 26, ears 28, nose 30, cheeks 32, lips 34, chin 36, and hair 38. The mask depicted would be worn over the face and in this embodiment has chemiluminescent reagents placed in the eyebrows 24, cheeks 32, and lips 34. The purpose of such a design is to make the costume mask a focal point for a costume which would then be worn throughout an evening thereby providing a level of safety. For instance, the face mask may include lips 34, that are filled with the chemiluminescent chemical of a bright red color. The cheeks 32 may be formed of a chemiluminescent reagent providing a pink color, the eyebrows 24 may be formed of a highlighting color such as blue. Further items may include placement of chemiluminescent reagents in neck, temple, eyeball, eye socket, veins, brain, skull, tongue, bone, or appendage.

Ribbons 33 in the pigtails 35 may include yet another color. The color may be from a chemiluminescent package located in the pigtail. For instance, a chemiluminescent package may consist of an inner pouch made of aluminum foil sealed along a periphery to form a cavity therein for containing the oxalate solution. An outer pouch that encompasses the inner pouch can be made of a polymer film such as polyolefin, polyethylene or polypropylene which is also sealed along its periphery for containing an activator liquid.

The package would include a steel ball or the like hard particle on which the user will push in order to pierce the aluminum pouch, and so induce the mixing process. It can also be conceived, that this ball or particle be not used, and that the pouch will be bursted by pressure. In that case, it is suitable to foresee an area of weakened resistance, for instance a welding line.

Such a package may also, optionally, include a woven or nonwoven material of which the fibers are preferably from the same polymer as the films of the outer pouch. During the storage of the lighting element before use, this felt will have time to absorb the whole of the activator liquid and spread it uniformly in the pouch. The result will be a good uniformity in emitted light after the liberation of the oxalate solution, because the two chemical liquids are miscible into each other within a short time.

Figure 2:
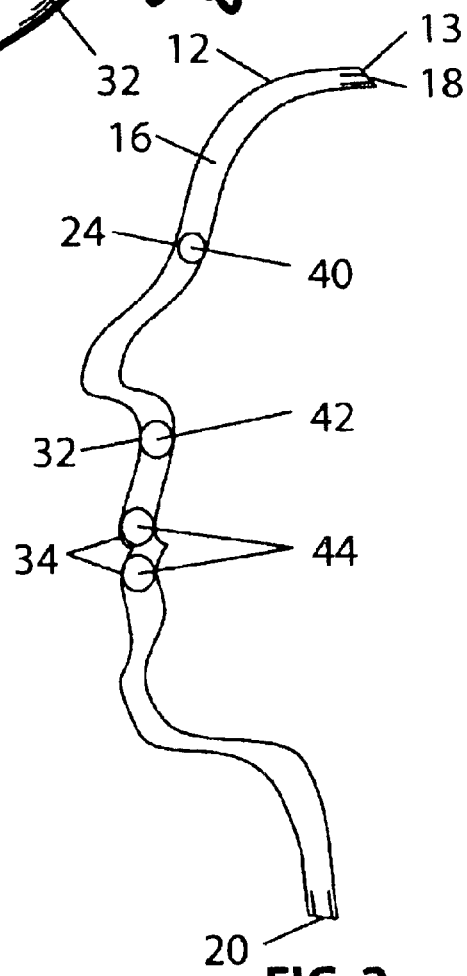
FIG. 2 is a partial cross sectional side view of FIG. 1.

The side surfaces 12 and 14 may also be constructed so as to provide cavities only in areas that the chemiluminescent reagents would be placed. Alternatively the previously mentioned packets such as those shown on FIG. 2 may be placed in strategic points such as the eyebrows 24, the cheek area 32, and lips 34. A solid such as that derived from a thixotropic component may be substituted for the liquid. Packet 40 is depicted behind the eyebrow in the mask. Packet 42 is shown in the location for the cheek while packets 44 are located in the lip section 34 of the mask. The face mask eliminates the need for placing make up on a young child yet affords the child an appearance of a character which they wish to depict such as Little Red Riding Hood, Jack and Jill, and so forth. The face mask may be made from a clear or transparent material depending upon the type of chemiluminescent reagent to be employed. Thus, the lips 34 may include a chemiluminescent chemical having a red fluorescer for striking clarity. Alternatively, the lip area may be made of a colored translucent material wherein the rumination viewed outside the mask would be that of the substrate coloring. Further, the mask may include opaque areas where illumination is not desired.

For purposes of this disclosure, the term "chemiluminescent reactant" is interpreted to mean a mixture or component thereof which will result in chemiluminescent light production when reacted with other necessary reactants in the processes as disclosed herein.

The term "fluorescent compound" is interpreted to mean a compound which fluoresces in a chemiluminescent reaction.

The term "chemiluminescent composition" is interpreted to mean a mixture which will result in chemiluminescence.

The term "thixotropic composition" is interpreted to mean an admixture which behaves as a pseudo fluid when force is applied to it, but has properties of a solid when at rest.

Chemiluminescent light production generally utilizes a two-component system to chemically generate light. Chemiluminescent light is produced by combining the two components, which are usually in the form of chemical solutions referred to as the "oxalate" component and the "activator" component. All suitable oxalate and activator compositions, inclusive of the various additional fluorescers, catalysts and the like, known to be useful in the prior art, are contemplated for use within the present invention.

When chemiluminescent materials are stored, the two components are kept physically separated prior to activation by a variety of means. Often, a sealed, frangible, glass vial containing one component is housed within an outer flexible container containing the other component. This outer container is sealed to contain both the second component and the filled, frangible vial. Forces created by intimate contact with the internal vial, e.g. by flexing, cause the vial to rupture, thereby releasing the first component, allowing the first and second components to mix and produce light. Since the objective of this type of device is to produce usable light output, the outer vessel is usually composed of a clear or translucent material, such as polyethylene or polypropylene, which permits the light produced by the chemiluminescent system to be transmitted through the vessel walls. These devices may be designed so as to transmit a variety of colors by either the addition of a dye or fluorescent compound to one or both of the chemiluminescent reactant compositions or to the vessel. Furthermore, the device may be modified so as to only transmit light from particularly chosen portions thereof.

In its most basic form the two-component, liquid phase oxalate ester chemical light system must comprise an "oxalate component" comprising an oxalic acid ester and a solvent, and a "peroxide component" comprising hydrogen peroxide and a solvent or mixture of solvents. Typically, an efficient fluorescer must be contained in one of the components. An efficient catalyst, necessary for maximizing intensity and lifetime control, may be contained in one of the components.

The oxalate component provides an oxalate ester-solvent combination which permits suitable ester solubility and storage stability. The peroxide component provides a hydrogen peroxide-solvent combination which permits suitable hydrogen peroxide solubility and storage stability. The solvents for the two components may be different but should be miscible. At least one solvent solubilizes the efficient fluorescer and at least one solvent solubilizes the efficient catalyst. The fluorescer and catalyst are normally placed as to permit both solubility and storage stability in the final components.

Typical suitable fluorescent compounds for use in the present invention are those which have spectral emission falling between 300 and 1200 nanometers and which are at least partially soluble in the diluent employed. Among these are the conjugated polycyclic aromatic compounds having at least 3 fused rings, such as: anthracene, substituted anthracene, benzanthracene, phenanthrene, substituted anthracene, benzanthracene, phenanthrene, substituted phenanthrene, naphthacene, substituted naphthacene, pentacene, substituted pentacene, perylene, substituted perylene, violanthrone, substituted violanthrone, and the like. Typical substituents for all of these are phenyl, lower alkyl ($C_1$–$C_6$), chloro, bromo, cyano, alkoxy ($C_1$–$C_{16}$), and other like substituents which do not interfere with the light-generating reaction contemplated herein.

Illustrative, albeit non-limiting examples of preferred fluorescers are 9,10-bis(phenylethynyl)anthracene, 1-methoxy9,10-bis(phenylethynyl)anthracene, perylene, 1,5-dichloro 9,10-bis(phenylethynyl)anthracene, rubrene, monochloro and dichloro substituted 9,10-bis (phenylethynyl)anthracene, 5,12-bis(phenylethynyl) tetracene, 9,10-diphenyl anthracene, and 16,17-dihexyloxyviolanthrone.

The term "peroxide component," as used herein, means a solution of a hydrogen peroxide compound, a hydroperoxide compound, or a peroxide compound in a suitable diluent.

The term "hydrogen peroxide compound" includes (1) hydrogen peroxide and (2) hydrogen peroxide-producing compounds.

Hydrogen peroxide is the preferred hydroperoxide and may be employed as a solution of hydrogen peroxide in a solvent or as an anhydrous hydrogen peroxide compound such as sodium perborate, sodium peroxide, and the like. Whenever hydrogen peroxide is contemplated to be employed, any suitable compound may be substituted which will produce hydrogen peroxide.

The lifetime and intensity of the chemiluminescent light emitted can be regulated by the use of certain regulators such as:

(1) by the addition of a catalyst which changes the rate of reaction of hydroperoxide. Catalysts which accomplish that objective include those described in M. L. Bender, "Chem. Revs.," Vol. 60, p. 53 (1960). Also, catalysts which alter the rate of reaction or the rate of chemiluminescence include those accelerators of U.S. Pat. No. 3,775,366, and decelerators of U.S. Pat. Nos. 3,691,085 and 3,704,231, or (2) by the variation of hydroperoxide. Both the type and the concentration of hydroperoxide are critical for the purposes of regulation.

Of the catalysts tried, sodium salicylate and various tetraalkylammonium salicylates have been the most widely used. Lithium carboxylic acid salts, especially lithium salicylate, lithium 5-t-butyl salicylate and lithium 2-chlorobenzoate are excellent catalysts for low temperature hydrogen peroxide/oxalate ester/fluorescer chemiluminescent systems.

Figure 3:
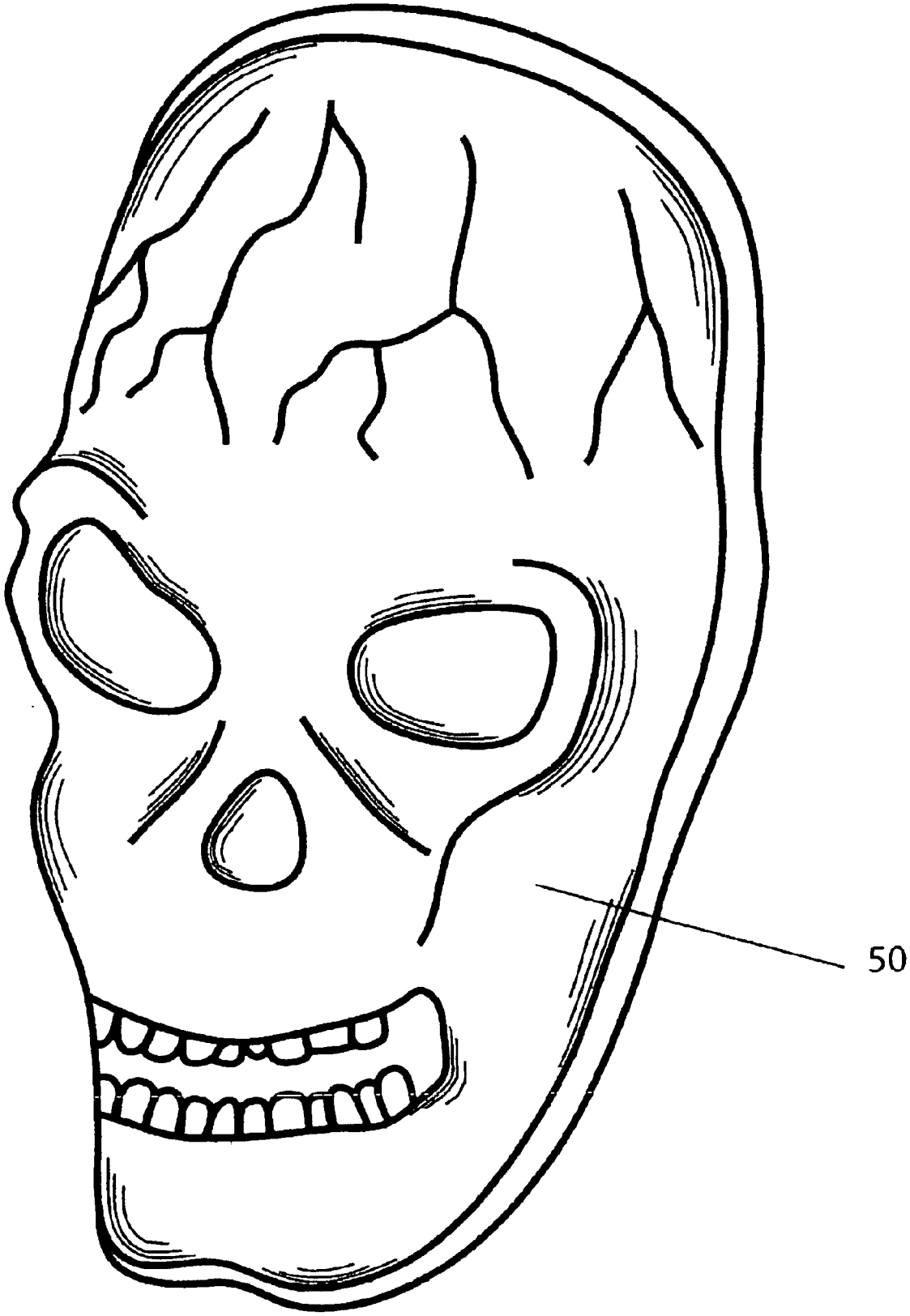
FIG. 3 is a perspective view of a horror face mask having a translucent shell for light diffusion of liquid chemiluminescent reagents.

Referring now to FIG. 3 set forth is an embodiment wherein the mask body includes transparent cavities 50, with a majority of the mask being made of transparent material. In this embodiment the transparent cavities would be used to house the chemiluminescent chemical which provides sufficient illumination to cause transparent sections of the mask to become illuminated. In any event, the safety of the wearer is enhanced as the illumination can be detected by drivers at night and as previously stated the mask becomes a focal point of the Halloween costume lessening the desire of removal by the wearer. The activator and oxalate ampules are sealed within the two layer mask. The effect is to provide a gravity "flowing liquid" mask with a return of the flowing liquid by inverting of the mask. The mask could be attached via a pivot point to a sub mask, not shown, which is attached to the wearer allowing inversion without removal. Further, a two face mask wherein one face can be viewed upright or inverted might be used. For instance, in one view a pretty woman could be shown, in the inverted view a witch woman may be shown.

In a basic embodiment a two layer mask may employ a chin located cavity that collects fluid as it drips and flows by gravity. The wearer may apply pressure from the inside or outside of the chin area to reduce the cavity volume and force fluid into the full area of the mask thus returning fluid to all areas of the mask. The mask forms could define pockets where fluid is collected after pressure is applied. The reduction of the cavity may also be accomplished by use of an air pump.

In another embodiment, a three layer mask may employ a semi-rigid inner and outer shell, with a flexible layer placed therebetween. The flexible layer may be sandwiched between the inner and outer layer wherein the squeezing of either layer would cause the flexible layer to cause fluid transfer, yet the flexible layer remains protected by the semi-rigid shells. The squeezing of a layer may be the result of manually applied pressure or differential air pressure between the layers. For instance, fluid drainage may cause the chin area of a face mask to become the storage area for the mask. Squeezing of the chin area may cause displacement of fluid. Further, blowing air into a chamber between one of the outer layers and the inner layer may provide the necessary fluid transfer.

Figure 4:
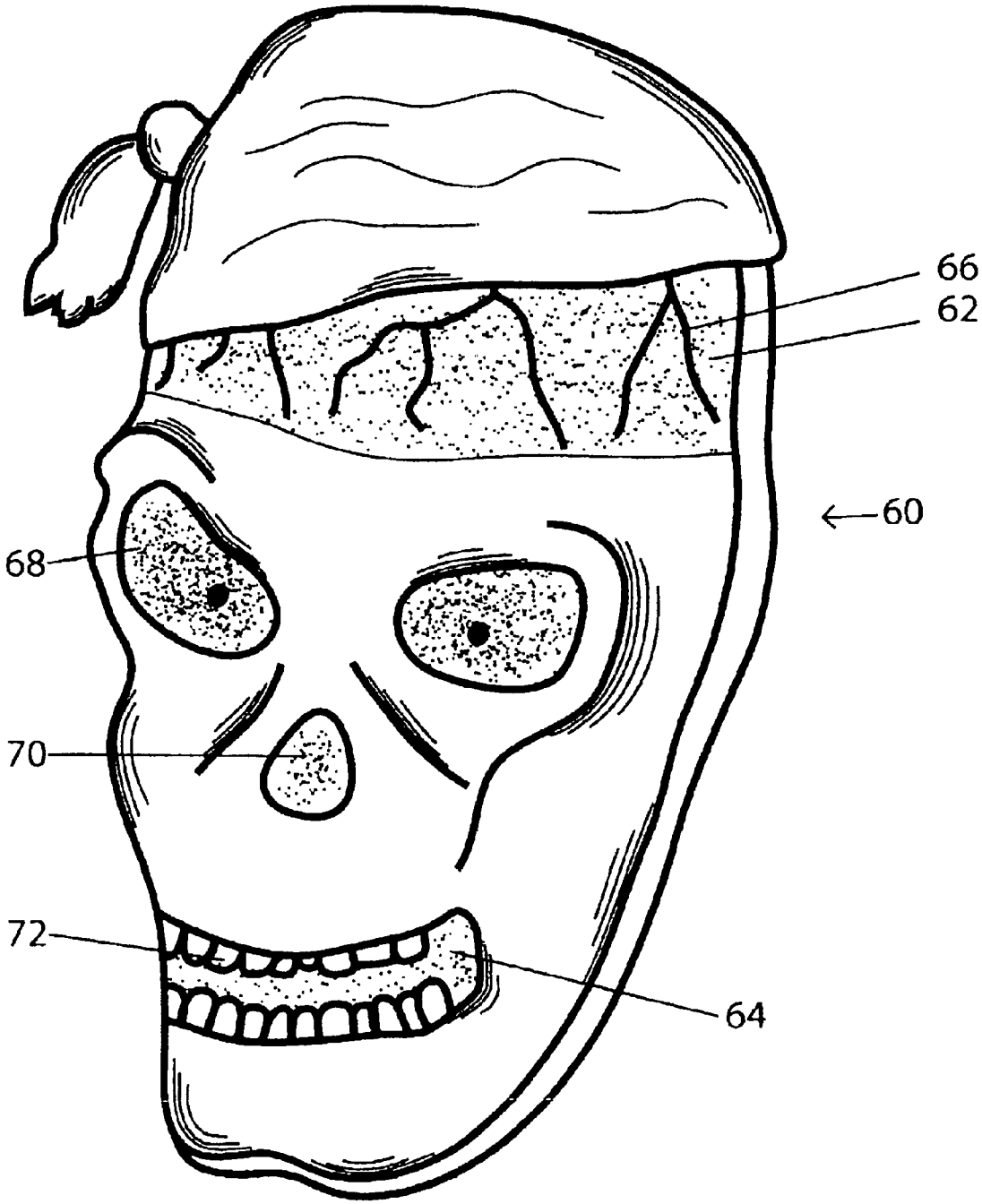
FIG. 4 is a perspective view of a horror face mask having a transparent shell with solid chemiluminescent reagents.

Referring now to FIG. 4, set forth is yet another embodiment wherein a face mask 60 is provided with a solid oxalate and liquid activator. In this embodiment forehead 62, and mouth area 64, is illuminated with the chemiluminescent chemical allowing multicolor glowing body parts to define glowing shapes. Opaque areas 66, are employed to provide the appearance of veins. Eye sockets 68, and nose 70, may include a different chemiluminescent reagent providing contrasting colors. Similarly teeth 72, are depicted in blue which in this embodiment provide a Halloween fright safety mask as the colors are abnormal to a living person.

Figure 5:
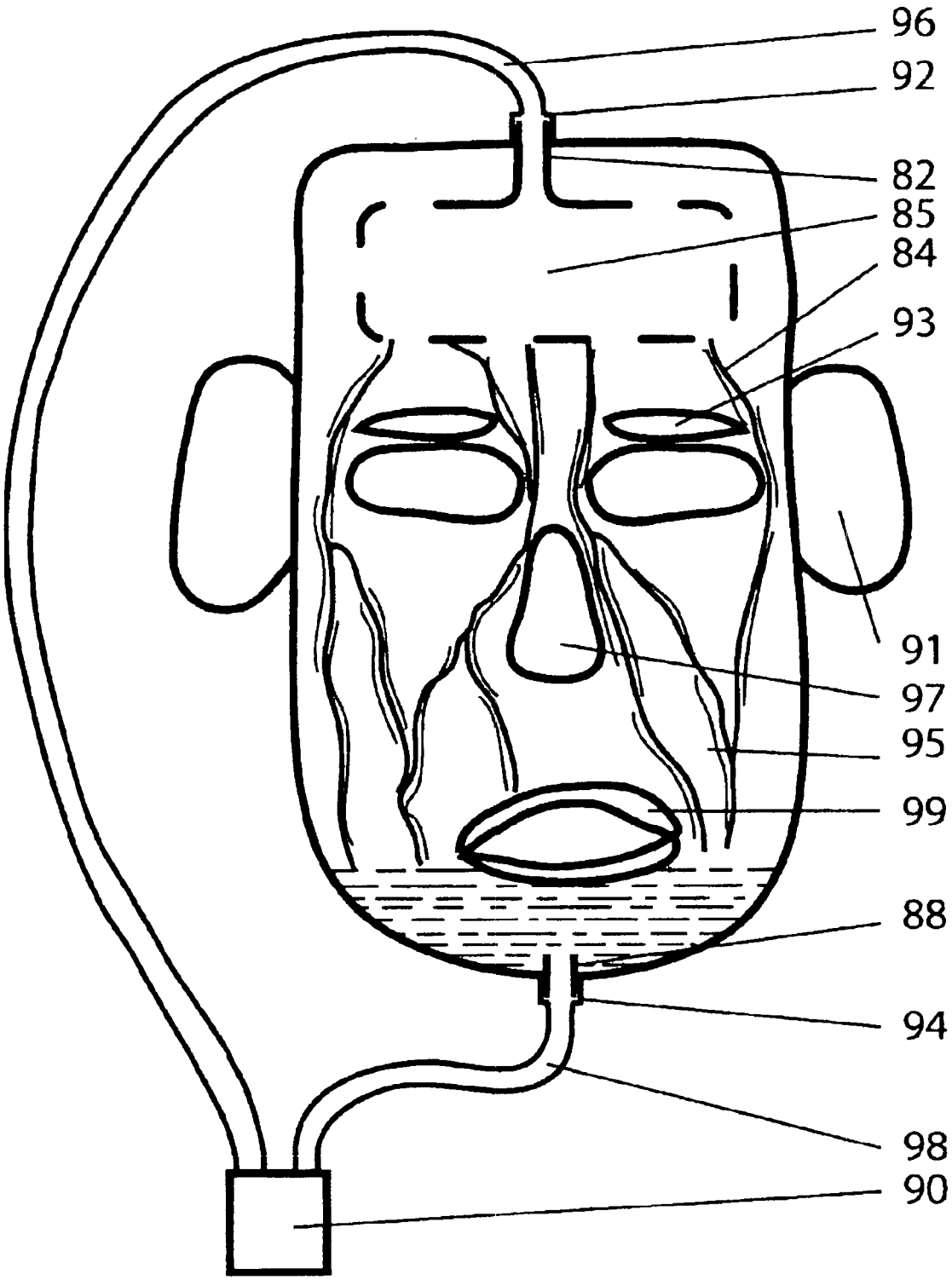
FIG. 5 is a perspective view of a horror face mask having a transparent shell with recirculated liquid chemiluminescent reagents.

FIG. 5 depicts a fright mask wherein a chemiluminescent reagent is directed through an opening 82, into the cavity 84. In this embodiment, the cavity is formed into a series of passageways that are strategically positioned throughout the mask leading to a collection cavity in the chin area 86. A second opening 88 can be used to drain the collection cavity wherein the reagent can be recirculated to opening 82 by use of a recirculation pump 90. Manual manipulation of the pump 90 allows the chemiluminescent reagent to be recirculated providing the appearance of fluid flowing throughout the mask. For instance, a green reagent may be recirculated to simulate make-believe alien blood. A red reagent would provide a make-believe human blood appearance.

In this embodiment, the recirculation pump may be remotely located from the mask wherein fluid transfer can be obtained by manual manipulation of the pump. The mask and pump could be considered disposable after use.

Alternatively, quick disconnects 92, and 94 are provided at the first and second openings to allow for the discoupling of the pump and transfer tubes 96, 98. Upon reagent exhaustion the reagents can be drained from the mask and disposed off in a proper manner. In this manner, a replacement pump with new reagents and interconnecting tubes can be used thereby allowing the mask to be reused. In addition, by changing of the reagents, different color combinations can be provided. For instance, a red mask for one occasion may be a blue mask for another occasion, and so forth.

In operation, tube 96 having quick disconnect 92 is inserted into opening 82, which is in fluid communication with the cavity 85. The cavity 85 may further consist of a series of passage ways 84 which extend throughout the mask. Cavity locations may include the ears 91, eyebrows 93, cheeks 95, nose 97 and lips 99. The passage ways branch from the opening and/or cavity to form the appearance of veins depicted by numeral 84.

The tube 96 is preferably made of a flexible material such as opaque plastic. The pump includes a first chamber containing either the chemiluminescent oxalate component or chemiluminescent activator, and a chamber filled with the second chemiluminescent oxalate component or chemiluminescent activator. The chambers are separated by a frangible or movable partition such that the device is available for activation upon fracturing or moving of the partition thereby allowing admixture of the oxalate and activator.

Upon activation of the reagents, the pump is operated thereby creating pressure and causing fluid to be injected into the mask cavity. Because the reagents glow, they are visible through transparent or translucent shell. Should a red color be chosen, the appearance would be that of a flowing lava stream trickling down the skull of a person, although not realistic, the color could also be interpreted as blood.

After the liquid flows down through the mask, the reagents drain into the bottom of mask and exit the opening to reenter the pump. Once the reagents return to the pump, the pump may be used again to recreate the circulation effect. Alternatively, the mask may have a cavity at the top and bottom section of the mask wherein refilling of the top cavity is performed by inverting the mask allowing the liquid to flow back to the top section. The top section cavity would then have an aperture allowing for the controlled draining back to the chin.

Although the costume safety mask made in accordance with the present invention can be shaped to form a human face, the shape can be made to simulate most any item. For instance, the mask may be formed into the shape of a valentines heart wherein the red chemiluminescent material results in a glowing heart. Similarly, veins, brain, skull, tongue, bone, or appendages can be simulated.

Unique to the use of chemiluminescent reagents is that the shell may include light transferring formations that lessen the need for chemical reagents by taking advantage of light enhancing formations. Shaped housings include those found in U.S. Pat. Nos. 5,043,851 and 5,488,544 the contents of which are incorporated herein by reference. In this embodiment, the side surfaces are formed to provide an augmented illumination surface.

Figure 6:
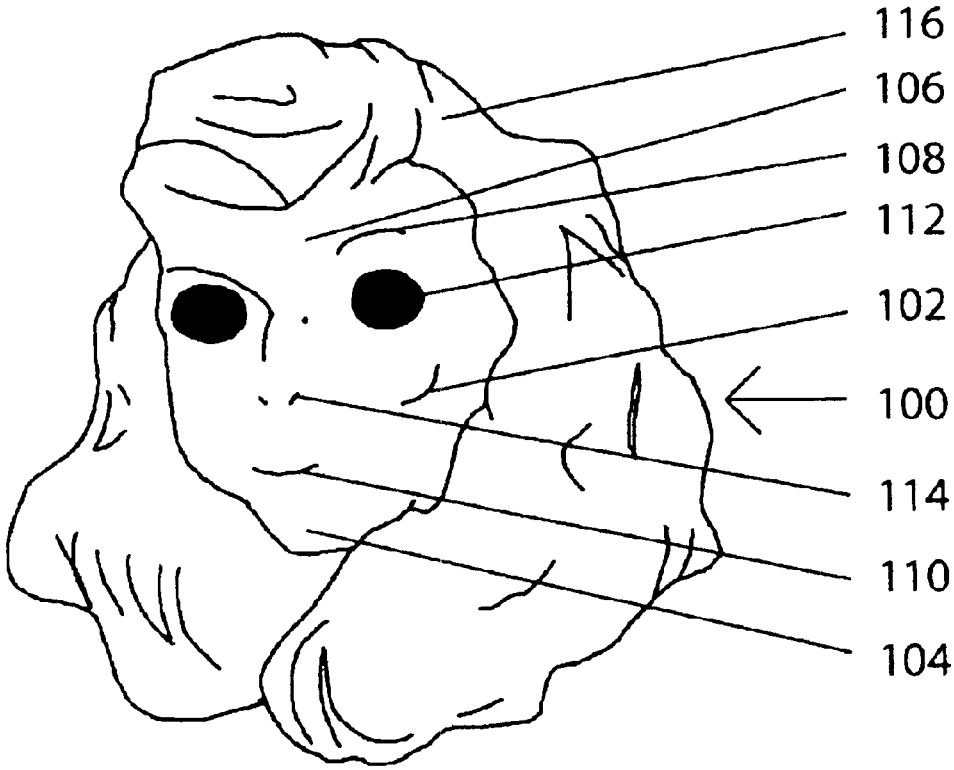
FIG. 6 is a perspective view of a child's face mask having lumination qualities.
Figure 7:
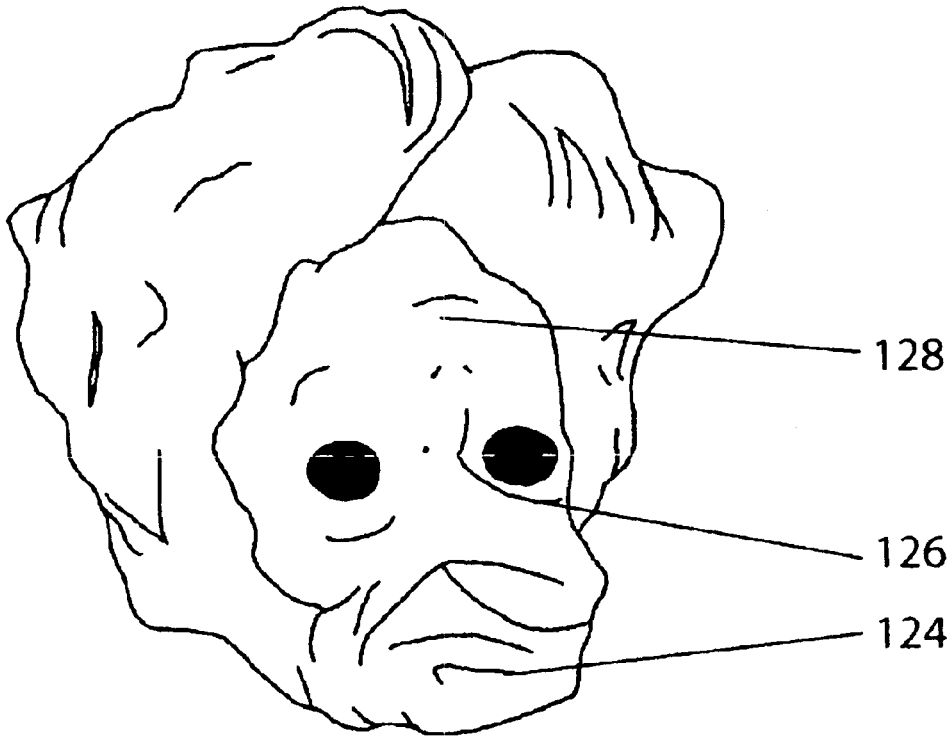
FIG. 7 is a perspective view of an elder's face mask having lumination qualities which mask is the same mask shown in FIG. 6, turned upside down.

FIG. 6 depicts a mask 100 that simulates a young girl wherein the liquid-liquid chemiluminescent reagents or liquid-dry chemiluminescent reagents can be used to highlight aspects of the mask. The safety mask may include cavities to highlight the cheek 102, chin 104, forehead 106, eyebrow 108, lip 110, eyeball 112, nose 114, hair 116 and so forth. The mask can be rotatably attached to a human head by the use of a hook and loop (VELCRO) strap and rotated so that the representation of the mask would change, for example, to that of an elderly woman, as shown in FIG. 7. Portions of the mask may be opaque to conceal fluids and other fluids may relocate to cause enhanced aged features. For example, the chin 124 may contain fluid that flowed from the young girl's hair 116. The eyeball 112 fluid may flow to the eyeball socket 126. The lips 110 having a concentrated fluid may flow to the general forehead area 128, and so forth. The result is a dual function mask having illumination for novelty as well as safety purposes.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A chemiluminescent costume safety article comprising: a mask body formed from a first plastic side surface sealingly attached to a second plastic side surface forming a cavity therebetween, said cavity sized to support chemiluminescent reagents having an oxalate component and a reactor component initially physically separated from each other; and a means for admixing said oxalate component and said reactor component which results in a chemical reaction that produces chemiluminescent light.

2. The costume safety mask according to claim 1 wherein at least one of said side surfaces is augmented to provide an enhanced illumination surface from said chemiluminescent light.

3. The costume safety mask according to claim 1 including a means for securing at least one of said side surfaces in a fixed position.

4. The costume safety mask according to claim 1 wherein at least one of said side surfaces is shaped to simulate a body part.

5. The costume safety mask according to claim 1 wherein said side surfaces are transparent allowing human features to be viewed through said mask body.

6. The costume safety mask according to claim 1 wherein a portion of said first or said second side surface is opaque.

7. The costume safety mask according to claim 1 wherein a portion of said first or said second side surface is translucent.

8. The costume safety mask according to claim 1 wherein said cavity is formed into passageways.

9. The costume safety mask according to claim 8 wherein said passageways permit active movement of said chemiluminescent reagents therethrough.

10. The costume safety mask according to claim 8 wherein said passageways include a first opening in fluid communication with second opening, said reagents flowing between said openings.

11. The costume safety mask according to claim 9 wherein movement means of said chemiluminescent reagents includes a pump.

12. The costume safety mask according to claim 11 wherein said fluid pump propels chemiluminescent fluid into at least one cavity.

13. The costume safety mask according to claim 12 wherein said fluid pump is hand-held.

14. The costume safety mask according to claim 1, wherein said first side surface and said second side surface are joined together by use of a liquid impermeable seal.

15. The costume safety mask according to claim 1, wherein said mask body includes a flexible material disposed between said first and second side surface, said flexible material causing fluid transfer when said flexible material is moved in relation to one of said side surface.

16. The costume safety mask according to claim 1, wherein said shell is a light-filtering plastic.

17. The costume safety mask according to claim 1 wherein said cavity formed for containing chemiluminescent reagents is from the following group: cheek, chin, forehead, ear, eyebrow, lip, neck, temple, eyeball, eye socket, teeth, nose, veins, brain, skull, tongue, bone, or appendage.

18. The costume safety mask according to claim 1 wherein said chemiluminescent reagents comprise a liquid oxalate and a liquid activator.

19. The costume safety mask according to claim 1 wherein said chemiluminescent reagents comprise a non-liquid component and a liquid component.

20. The costume safety mask according to claim 1 wherein said chemiluminescent reagents are placed in a package secured to one of said side shells, said package comprising a frangible chamber filled with a first chemiluminescent reagent enclosed within a translucent chamber having a second chemiluminescent reagent, said first frangible chamber having a means to allow rupturing of said frangible chamber to allow admixing of said reagents to produce chemiluminescent light.

21. The costume safety mask according to claim 1 including a woven or nonwoven material saturated with one of said chemiluminescent reagents with said second chemiluminescent reagent stored adjacent thereto, wherein admixing said second reagent to said first reagent produces chemiluminescent light.

22. A costume safety mask according to claim 1 wherein said mask is rotatable about a pivot point or is removably attached and may be inverted and reattached.

23. A costume safety mask according to claim 1 wherein the viscosity of at least one of said chemiluminescent reagents is controlled to achieve desired fluidity.

24. A costume safety mask according to claim 1 wherein said mask alters its appearance upon reorientation.

* * * * *